US009552692B2

(12) United States Patent
Muir et al.

(10) Patent No.: US 9,552,692 B2
(45) Date of Patent: Jan. 24, 2017

(54) DUTY FREE GAMING REWARDS

(75) Inventors: David Muir, Newcastle (AU); Daniel DeWaal, Las Vegas, NV (US); Anthony Baerlocher, Reno, NV (US); Leslie Swift, Reno, NV (US)

(73) Assignee: IGT, Las Vegas, NV (US)

( * ) Notice: Subject to any disclaimer, the term of this patent is extended or adjusted under 35 U.S.C. 154(b) by 1090 days.

(21) Appl. No.: 13/069,548

(22) Filed: Mar. 23, 2011

(65) Prior Publication Data

US 2012/0244946 A1 Sep. 27, 2012

(51) Int. Cl.
*G07F 17/32* (2006.01)

(52) U.S. Cl.
CPC ..... *G07F 17/3237* (2013.01); *G07F 17/3244* (2013.01); *G07F 17/3267* (2013.01)

(58) Field of Classification Search
CPC .. G07F 17/32; G07F 17/3244; G07F 17/3237; G07F 17/3267; G07F 17/3258
USPC ..... 463/16, 25–29, 32, 42
See application file for complete search history.

(56) References Cited

U.S. PATENT DOCUMENTS

| | | | | |
|---|---|---|---|---|
| 5,505,461 | A | 4/1996 | Bell et al. | |
| 6,312,333 | B1 | 11/2001 | Acres | |
| 6,890,257 | B2 | 5/2005 | Baerlocher | |
| 6,966,833 | B2 | 11/2005 | Kaminkow et al. | |
| 7,001,273 | B2 | 2/2006 | Baerlocher | |
| 7,004,466 | B2 | 2/2006 | Gauselmann | |
| 7,192,349 | B2 | 3/2007 | Baerlocher et al. | |
| 7,963,842 | B2 | 6/2011 | Ruymann | |
| 8,210,931 | B2 * | 7/2012 | Alderucci et al. | 463/25 |
| 2002/0147040 | A1 | 10/2002 | Walker et al. | |
| 2003/0083126 | A1 | 5/2003 | Paulsen | |
| 2003/0104862 | A1 | 6/2003 | Acres | |
| 2003/0228901 | A1 | 12/2003 | Walker et al. | |
| 2004/0010556 | A1 | 1/2004 | Kawakita et al. | |
| 2004/0110554 | A1 | 6/2004 | Bromfield | |
| 2004/0110556 | A1 | 6/2004 | Bromfield | |
| 2004/0235551 | A1 | 11/2004 | Walker et al. | |
| 2004/0242319 | A1 * | 12/2004 | Walker et al. | 463/25 |
| 2005/0170884 | A1 * | 8/2005 | Okada | 463/25 |
| 2006/0205494 | A1 * | 9/2006 | Fujimoto | 463/29 |
| 2007/0099696 | A1 * | 5/2007 | Nguyen et al. | 463/25 |
| 2007/0135206 | A1 * | 6/2007 | Inamura | 463/20 |
| 2007/0254732 | A1 | 11/2007 | Walker et al. | |
| 2007/0259713 | A1 | 11/2007 | Fiden et al. | |

(Continued)

OTHER PUBLICATIONS

Office Action for European Patent Application Serial No. 12 155 545.2, dated May 3, 2013 (6 pages).

*Primary Examiner* — Omkar Deodhar
*Assistant Examiner* — Shauna-Kay Hall
(74) *Attorney, Agent, or Firm* — Neal, Gerber & Eisenberg LLP

(57) ABSTRACT

A gaming machine including an interface unit configured to accept game play data from a player, and a controller coupled to the interface unit. The controller includes a processor and a memory, wherein the memory stores player tracking data and wherein the processor is configured to receive, via the interface unit, game play data for the player playing a primary game, initiate a play of a secondary game if a triggering event occurs, enable a player to select at least one of a plurality of different loyalty awards associated with the secondary game, determine an outcome of the secondary game, and issue a loyalty award based on the determined outcome of the secondary game.

14 Claims, 5 Drawing Sheets

(56) References Cited

U.S. PATENT DOCUMENTS

| | | | | |
|---|---|---|---|---|
| 2008/0070700 | A1* | 3/2008 | Inamura | 463/42 |
| 2008/0242392 | A1* | 10/2008 | Inamura | 463/17 |
| 2009/0104979 | A1* | 4/2009 | Ruymann | 463/25 |
| 2010/0120502 | A1 | 5/2010 | Oberberger | |

* cited by examiner

DUTY FREE GAMING REWARDS

BACKGROUND

In order to initiate a gaming session, a player typically inserts a token or money into a gaming machine to establish credits on the gaming machine. The player then chooses the size of the bet and begins the game by pressing a button or pulling a lever. If the game is a winner, a jackpot is paid to the player in accordance with the outcome of the game, pay tables and the amount of the bet. In some cases, small jackpots are won. The small jackpots are typically paid by increasing the player's credits or cashing out. With regards to cashing out, coins may drop in a hopper or alternatively the player may receive a printed ticket that can be exchanged for cash or inserted into a bill acceptor of another machine to add previously accumulated credits to the credit meter of the new machine.

In other cases, large jackpots are won. Large jackpots typically don't follow the same rules because of gaming and tax regulations. Normally, a win of $1200.00 or more requires that the gaming machine lock up and wait so that a gaming operator can gather data from the winning player and the gaming machine. The data is used to complete a variety of forms in accordance with gaming and tax regulations (e.g., a W2-G form). As should be appreciated, because the gaming industry handles and transfers sizable amounts of value, for example, in the form of coin, paper currency, and electronic media, federal, state and local taxing agencies are interested in accurate reporting of the value transfers involved.

Unfortunately, this process takes some time thereby interrupting a player's gaming session, which leaves a negative impression on the player. Typically, the gaming operator is not available at the time of the jackpot as they may be performing other tasks. Further, the gaming operator must gather the appropriate forms. Thus, it may take some time before the gaming operator even gets to the machine. Once the gaming operator is at the machine, data from the gaming machine is obtained and the required forms are filled out completely by the gaming operator as well as by the player. For example, the player may be required to provide information including name, social security number, address, as well as a signature. Once this process is complete, the gaming operator restarts the gaming machine so that the gaming session can continue. At a bare minimum, this can take about 15 minutes, but typically takes much longer.

This problem is exacerbated when you consider high roller machines that readily accept bets of up to $1000.00. Any payout that doubles this bet creates the aforementioned interruptions. Since these payouts are very common, interruptions are typically incurred over and over again during a gaming session thereby worsening the problem.

BRIEF DESCRIPTION OF THE INVENTION

The present disclosure expands on a desire of gaming establishments to keep customers unhindered by "over tax" triggering events. The present disclosure describes utilizing a tax free pay table to determine rewards issued to customers.

In one embodiment, a gaming machine is provided that includes an interface unit configured to accept game play data from a player playing a game, and a controller coupled to the interface unit. The controller includes a processor and a memory, wherein the memory stores a tax free pay table. The processor is configured to receive, via the interface unit, game play data for the player playing the game, determine, via the tax free pay table, a reward associated with an outcome of the game, determine a tax liability corresponding to the reward if the reward exceeds a taxable amount, send payment of the calculated tax liability to the internal revenue service; and issue the reward tax free to the player.

In another embodiment, a system is provided that includes at least one server. The at least one server includes a memory configured to store tax information of a plurality of tax jurisdictions. The system also includes a gaming machine communicatively coupled to the at least one server via a gaming network. The gaming machine includes a processor programmed to receive, via the interface unit, game play data for the player playing a game on the gaming machine, determine, via the tax free pay table, a reward associated with an outcome of the game, determine a tax liability corresponding to the reward if the reward exceeds a taxable amount, send payment of the calculated tax liability to the internal revenue service, and issue the reward tax free to the player.

In still another embodiment, a method is provided that includes receiving, via the interface unit, game play data for the player playing a game on a gaming machine, determining, via the tax free pay table, a reward associated with an outcome of the game, determining a tax liability corresponding to the reward if the reward exceeds a taxable amount, sending payment of the calculated tax liability to the internal revenue service, and issuing the reward tax free to the player.

In still another embodiment, a method is provided that includes receiving, via the interface unit, game play data for the player playing a primary game on a gaming machine, determining an initial reward associated with an outcome of the primary game, determining if the initial reward exceeds a taxable amount, issuing the player a maximum amount of the initial reward that is not taxable, dividing a remainder of the initial reward not issued to the player into one or more remainder rewards that are below the taxable amount, initiating a play of a secondary game in response to issuing the player a maximum amount of the initial reward that is not taxable, and issuing the player each of the one or more remainder rewards in separate installments based on one or more outcomes of the secondary game.

BRIEF DESCRIPTION OF THE DRAWINGS

The present disclosure is described in detail below with reference to the attached drawing Figures.

DETAILED DESCRIPTION OF THE INVENTION

Figure 1:
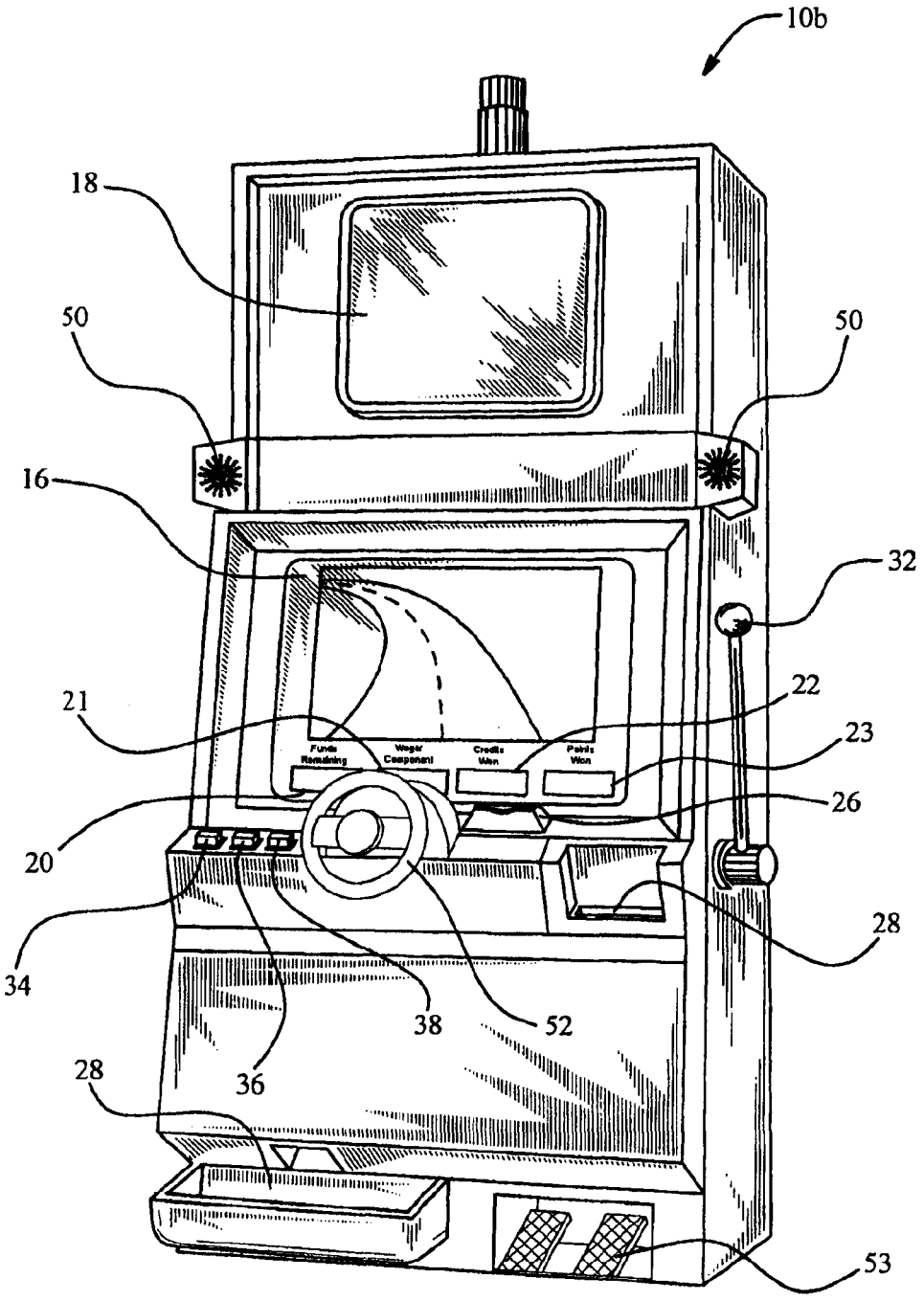
FIG. 1 is perspective illustration of an exemplary gaming machine.

The present disclosure expands on a desire of gaming establishments to keep customers unhindered by "over tax" triggering events, such as filling out a W2-G form. In some embodiments, the present disclosure describes gaming machines, systems, and methods for utilizing a modified pay table (e.g., a tax free pay table) to issue rewards to players tax free (e.g., by creating a pay table where the top rewards are tax free). When a reward that would normally be taxed to a player is issued, a tax liability is deposited to the internal revenue serve rice (IRS) automatically, via a server, at no charge to the player. Thus, the tax free pay table represents a win pool where taxes have already been "deducted," and therefore, the tax free pay table represents rewards that are tax free to a player. Both gaming establishments and players alike will appreciate not only not being unhindered in play, but also being shown a true "take home" value of a reward, and not a pre-tax reward.

In some embodiments, a server-based network interfaces with other property systems to incorporate a tax free pay table into a current game being played. For example, tax information regarding one or more tax jurisdictions may be analyzed to determine a tax free pay table. Providing a player an opportunity to win tax free rewards provides many advantages, such as, but not limited to, eliminating player disappointment due to rewards being reduced by taxes, limiting game play interruptions, providing anonymous game play, seamless automation of tax liability upon generation, and enabling gaming establishments to make arrangements with the IRS.

Taxable gaming events are not only seen as hindering an enjoyable gaming session, but taxable gaming events impose time and post event processing costs on both a player and associated gaming establishment. Providing a seamless method to keep players at a gaming "front" returns a percentage increase in handle.

In further embodiments, instead of awarding a player reduced rewards that are tax free, taxable rewards may be divided into one or more non-taxable rewards. For example, an initial taxable reward may be distributed over a series of statistically heightened games in a secondary game. In this mode, and according to regulatory needs, a series of games may be played during which (via various game definition options) odds of pay tables, feature games, and the like are statistically heightened to give an advantage to a player to provide non-taxable rewards that, when combined, are statistically equal or above the initial reward. The statistically heightened secondary game mode is not only controlled by a server, but exists as a persistent "state of play" that is statistically defined and modifiable until the secondary game has been completed.

The primary and secondary games described herein may incorporate any of the types of games described herein, as well as any suitable wheel game, any suitable selection game, any suitable offer and acceptance game, any suitable cascading symbols game, any suitable ways to win game, any suitable scatter pay game or any other suitable type of game.

The present disclosure may be implemented in various configurations for gaming machines or gaming machines, including but not limited to: (1) a dedicated gaming machine or gaming machine, wherein the computerized instructions for controlling the games, provided by the gaming machine or gaming machine, are stored within the gaming machine or gaming machine prior to delivery to a gaming establishment; and/or (2) a changeable gaming machine or gaming machine, wherein the computerized instructions for controlling the games are subsequently downloaded to the gaming machine or gaming machine through a data network after the gaming machine or gaming machine is in a gaming establishment.

Figure 3:
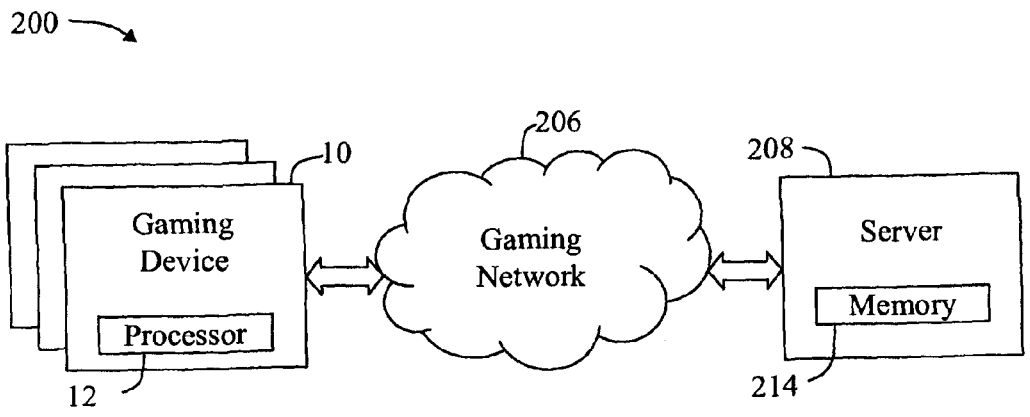
FIG. 3 is a block diagram of an exemplary gaming network that may be used with a plurality of gaming machines, such as the gaming machine shown in FIG. 1.

As illustrated in FIG. 3, in some embodiments, the computerized instructions for controlling any games are executed by a server 208, for example, a central controller or remote host. In such an embodiment known as a "thin client," server 208 remotely controls the games, or other suitable interfaces, via a gaming network 206, and a gaming machine 10 is used to display the games, or suitable interfaces, and to receive inputs or commands from a player.

In another embodiment, the computerized instructions for controlling any games are communicated from server 208 to a local processor and memory coupled within gaming machine 10. In such any embodiment, in a "thick client" the gaming machine 10 local processor executes the communicated computerized instructions to control any games or other suitable interfaces provided to a player.

One or more of the gaming machines 10 in gaming system 200 may be thin client gaming machines and one or more of the gaming machines 10 in gaming system 200 may be thick client gaming machines. In another embodiment, certain functions of gaming machine 10 are implemented in a thin client environment and certain other functions of gaming machine 10 are implemented in a thick client environment. In one such embodiment, computerized instructions for controlling the games are communicated from server 208 to each gaming machine 10 in a thick client configuration and computerized instructions for controlling any secondary games or bonus functions are executed by server 208 in a thin client configuration.

In the exemplary embodiment, and as shown in FIG. 1, gaming machine 10 includes a support structure, housing, or cabinet 2 that provides support for a plurality of interface units, displays, inputs, controls and other features of a conventional gaming machine. Device 10 is configured so that a player can operate it while standing or sitting. Moreover, device 10 may be positioned on a base or stand, or can be configured as a pub-style table-top game (not shown) that a player can operate while seated. Gaming machine 10 is not limited to only being the device illustrated in FIG. 1, but as will be appreciated by one of ordinary skill in the art, device 10 may have varying cabinets 2 and display configurations, without departing from the scope of the present invention.

Figure 2:
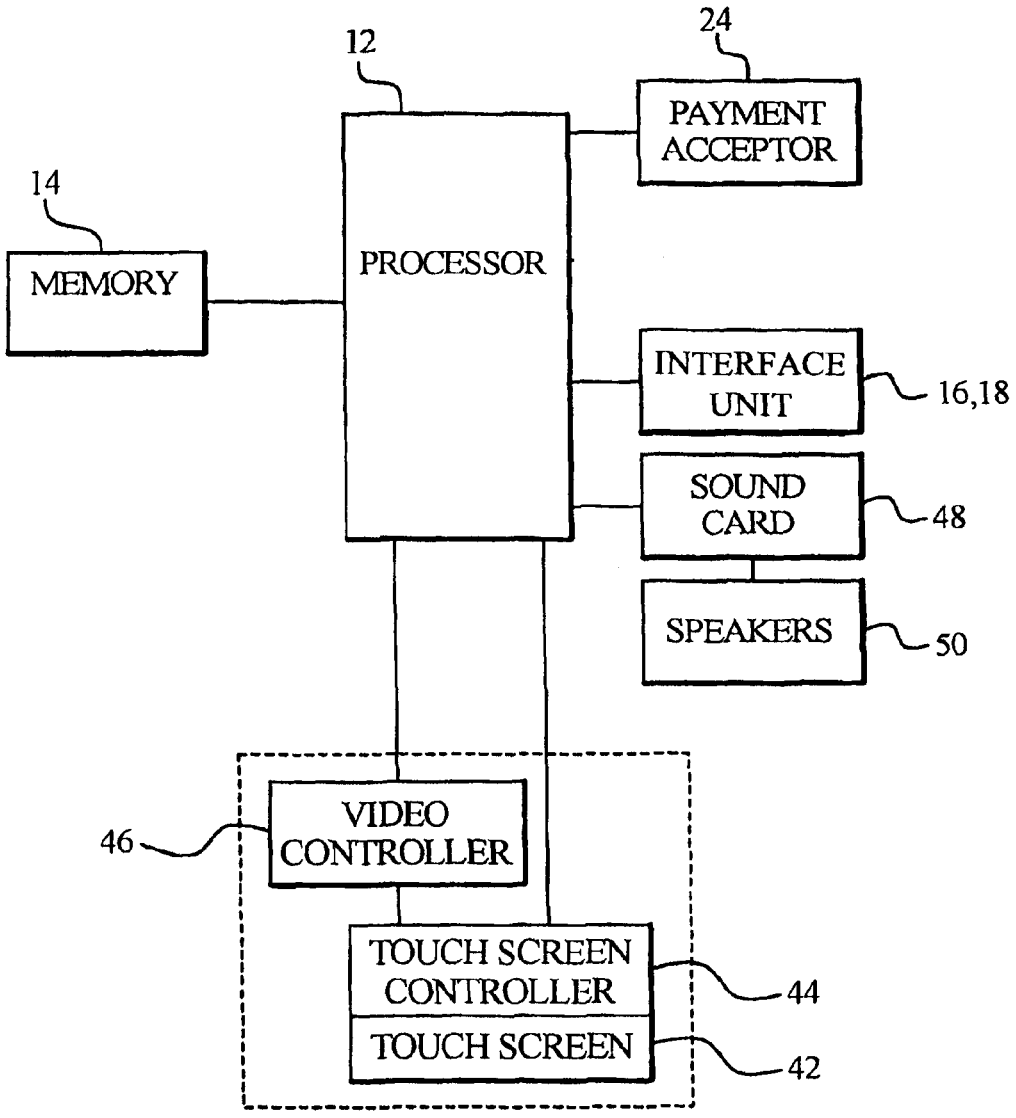
FIG. 2 is a block diagram of an exemplary electronic configuration of a gaming machine, such as the gaming machine shown in FIG. 1.

In the exemplary embodiment, and as shown in FIG. 2, gaming machine 10 includes at least one processor 12 or other suitable controller, such as a microprocessor, a microcontroller-based platform, a suitable integrated circuit or one or more application-specific integrated circuits (ASIC's). Processor 12 is coupled in communication with, or is operable to access or to exchange signals with at least one data storage module or memory 14. In one embodiment, processor 12 and memory 14 reside within gaming machine cabinet 2. Memory 14 stores program code and instructions, executable by processor 12, to control gaming machine 10. Memory 14 also stores other data such as, image data, tax free pay tables, event data, player input data, random or pseudo-random number generators, look-up table data, payback data or information and applicable game rules that relate to the play of gaming machine 10. In one embodiment, memory 14 includes random access memory (RAM), that can include non-volatile RAM (NVRAM), magnetic RAM (MRAM), ferroelectric RAM (FeRAM) and other forms as commonly understood in the gaming industry. In another embodiment, memory 14 includes read only memory (ROM). In yet another embodiment, memory 14 includes flash memory and/or EEPROM (electrically erasable programmable read only memory). Any other suitable magnetic, optical and/or semiconductor memory may be used to operate in conjunction with gaming machine 10 that enables device 10 to function as described herein. In embodiments, processor 12 executes computer-executable instructions to issue players tax free rewards.

In embodiments, part or all of the program code and/or operating data described above is stored in a detachable or removable memory, including, but not limited to, a suitable cartridge, disk, CD ROM, DVD or USB memory device. Moreover, in other embodiments, part or all of the program code and/or operating data described above is downloadable to memory 14 through a suitable network.

An operator or a player can use such a removable memory in a desktop computer, a laptop personal computer, a personal digital assistant (PDA), portable computing device, or other computerized platform to implement the present disclosure. In one embodiment, the gaming machine 10 or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that each gaming machine 10 or gaming machine disclosed herein may be a device that has obtained approval from a regulatory gaming commission or a device that has not obtained approval from a regulatory gaming commission. It should also be appreciated that processor 12 and memory 14 may be collectively referred to herein as a "computer" or "controller."

In the exemplary embodiment, and as shown in FIGS. 1 and 2, gaming machine 10 includes one or more interface units 16 and 18 that are controlled by processor 12. Units 16 and 18 are preferably coupled to cabinet 2 to display a game and to accept game play data from a player. Moreover, interface unit 16 may also display information relating to an interactive game, wager triggering event, or wagering outcome. Alternatively, gaming machine 10 may include only display 16 or 18. In the exemplary embodiment, upper interface unit 18 may display any wagering outcome, any suitable secondary game associated or not associated with the interactive game, and/or any information relating to the interactive games. Display 18 is also configured to accept game play data from a player. These interface units 16 and 18 may also serve as digital glass operable to advertise games or other aspects of the gaming establishment. In the exemplary embodiment, gaming machine 10 also includes a credit or fund display 20 which displays a player's current number of credits, cash accumulated, account balance, or an original number of credits the player funded the gaming machine with, or an equivalent of any of the aforementioned. Moreover, in the exemplary embodiment, gaming machine 10 includes a wager component display 21 that displays an amount being wagered and also includes an amount of credits won display 22 that displays a player's accumulated winnings. Furthermore, in the exemplary embodiment, gaming machine 10 includes an interactive game display, such as a points display 23 that displays a player's points for an interactive game.

In another embodiment, at least one interface unit may be a mobile display device, such as a PDA or tablet PC that enables play of at least a portion of the games at a location remote from gaming machine 10.

Interface units 16 and/or 18 may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, at least one interface unit 16 and/or 18 includes a touch-screen, for example touch-screen 42, that is used with an associated touch-screen controller, for example touch-screen controller 44. Moreover, interface units 16 and/or 18 may be of any suitable size and configuration, such as a circular, square, or rectangular.

Interface units 16 and 18 display at least one, and preferably a plurality of, games or other suitable images, symbols and indicia such as any visual representation or exhibition of a movement of objects such as mechanical, virtual or video reels and wheels, dynamic lighting, video images, images of people, characters, places, things and faces of cards, and the like. In one embodiment, the symbols, images and indicia displayed on or of the interface unit are in a mechanical form. That is, interface unit 16 and/or 18 may include any electromechanical device, such as one or more mechanical objects, such as one or more rotatable wheels, reels or dice, configured to display at least one or a plurality of games or other suitable images, symbols or indicia.

In the exemplary embodiment, gaming machine 10 includes at least one payment acceptor 24 coupled in communication with processor 12. Payment acceptor 24 may include a coin slot 26 and a payment, note, or bill acceptor 28, wherein a player may insert money, coins, or tokens. In other embodiments, devices such as readers or validators for credit cards, debit cards, or credit slips may accept payment. In one embodiment, a player may insert an identification card (not shown) into a card reader of gaming machine 10. The identification card may be a smart card that includes a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to gaming machine 10. In one embodiment, money may be transferred to gaming machine 10 via an electronic funds transfer. When a player funds gaming machine 10, processor 12 determines an amount of funds entered and displays the corresponding amount on the credit or other suitable display as described above.

Gaming machine 10 includes at least one input device that is coupled in communication with processor 12. Input devices can include any suitable device that enables the player to produce an input signal that is receivable by processor 12. For example, in one embodiment, after funding gaming machine 10, the input device is a game activation device, such as a pull arm 32 or a play button 34 that enables the player to start the game or a sequence of events in gaming machine 10. Play button 34 can be any suitable play activator such as a bet one button, a max bet button, or a repeat the bet button. In one embodiment, after appropriate funding of gaming machine 10, the game play begins automatically. In another embodiment, after a player engages one of the play buttons, such as button 36, gaming machine 10 automatically activates game play.

In the exemplary embodiment, one input device is a "Bet One" button 36. The player places a bet by pushing Bet One button 36 and can increase the bet by pushing Bet One button 36. When the player pushes Bet One button 36, the number of credits shown in the credit display decreases by one, and the number of credits shown in the bet display increases by one. In another embodiment, one input device is a "Bet Max" button (not shown) that enables the player to bet the maximum wager component permitted for a game of gaming machine 10.

In the exemplary embodiment, one input device is "Cash Out" button 38. The player may push Cash Out button 38 to receive a cash payment or other suitable form of payment corresponding to the number of credits remaining. In one embodiment, when the player cashes out, the player receives coins or tokens in a coin payout tray 28. In another embodiment, when the player cashes out, the player receives other payout mechanisms, such as tickets or credit slips, that are redeemable by a cashier (or other suitable redemption system), or funding to the player's electronically recordable identification card.

As best seen in FIG. 2, one input device is a touch-screen 42 (e.g., display 16) that is coupled to a touch-screen controller 44, or some other touch-sensitive display overlay to enable player interaction with images on display 16 and/or 18. Touch-screen 42 and the touch-screen controller 44 are connected to a video controller 46. A player can input signals into gaming machine 10 by touching touch-screen 42.

Gaming machine 10 may also include a plurality of communication ports for enabling communication of processor 12 with external peripherals, such as external video sources, expansion buses, game or other displays, an SCSI port or a key pad. In the exemplary embodiment, gaming machine 10 includes a sound generating device (not shown) controlled by one or more sounds cards 48 that are controlled by processor 12. In one embodiment, the sound generating device includes at least one speaker 50 or other sound generating hardware and/or software for use in generating sounds, such as playing music for the game or for other operating modes of gaming machine 10. In one embodiment, gaming machine 10 provides dynamic sounds, coupled with attractive multimedia images displayed on one or more of the interface units 16 and 18, to provide an audio-visual representation or to otherwise display full-motion video with sound to attract potential players gaming machine 10. During idle periods, gaming machine 10 may display a sequence of audio and/or visual attraction messages to attract potential players to gaming machine 10. The videos may also be customized to provide any appropriate information.

Gaming machine 10 may include a sensor, such as a camera (not shown) coupled in communication with processor 12, and possibly controlled by processor 12 to be selectively positionable to acquire an image of a player actively playing gaming machine 10, and/or a surrounding area of gaming machine 10. In one embodiment, the camera may selectively acquire still or moving (e.g., video) images and may be configured to acquire the images in either an analog, digital, or other suitable format. Interface units 16 and 18 may be configured to display the image acquired by the camera, as well as to display the visible manifestation of the game in split screen or picture-in-picture fashion. For example, the camera may acquire an image of the player and processor 12 may incorporate that image into the interactive and/or secondary game as a game image, symbol or indicia.

Gaming machine 10 may also include a global positioning satellite (GPS) device (not shown). The GPS device may be used for identifying a location of gaming machine 10, and more particularly, indentifying a tax jurisdiction gaming machine 10 physically resides in at a time of the game play. Thus, server 208 can access a location of gaming machine 10 and create a tax free pay table based on the identified tax jurisdiction.

One or more of gaming machine 10 may be in communication with server 208 (shown in FIG. 3) for monitoring purposes. That is, each individual gaming machine 10 randomly generates game outcomes that are provided to the player and server 208 monitors the activities and events occurring on the plurality of gaming machines 10. In the exemplary embodiment, gaming network 206 (shown in FIG. 3) includes a real-time or on-line accounting and gaming information system that is operably coupled to server 208. The accounting and gaming information system of this embodiment includes a player database for storing player profiles, a player tracking module for tracking players and a credit system for providing automated casino transactions.

In one embodiment, gaming machine 10 is associated with, or otherwise integrated into, one or more player tracking systems that include player transaction history. More specifically, gaming machine 10 and/or the player tracking system tracks any players gaming activity at gaming machine 10. In one embodiment, gaming machine 10 and/or the associated player tracking system tracks when a player inserts their playing tracking card to begin a gaming session and also timely tracks when a player removes their player tracking card when concluding play for that gaming session. In another embodiment, rather than requiring a player to insert a player tracking card, gaming machine 10 utilizes one or more portable devices carried by a player, such as a cell phone, a radio frequency identification tag or any other suitable wireless device to track when a player begins and ends a gaming session. In a further embodiment, gaming machine 10 utilizes any suitable biometric technology or ticket technology to track when a player begins and ends a gaming session.

During gaming sessions, gaming machine 10 and/or player tracking system tracks any suitable information, such as any amounts wagered, the interactive game outcomes, wagering outcomes, average wager components and/or the time these wagers are placed, as well as a transaction history, such as purchases made within or associated with a gaming establishment, for example, hotel rooms, drinks, clothes, massages, haircuts, dinners, souvenirs, shows, movies, and the like. In another embodiment, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data.

In the exemplary embodiment, a plurality of gaming machines 10 are connected together through a data network. In one embodiment, the data network is a local area network (LAN), in which one or more of gaming machines 10 are substantially proximate to each other and an on-site central server or controller as in, for example, a gaming establishment or a portion of a gaming establishment. In another embodiment, the data network is a wide area network (WAN) in which one or more of gaming machines 10 are in communication with at least one off-site central server or controller. In this embodiment, the plurality of gaming machines 10 may be located in a different part of the gaming establishment or within a different gaming establishment than the off-site central server or controller. Thus, the WAN may include an off-site central server or controller and an off-site gaming machine located within gaming establishments in the same geographic area, such as a city or state. The WAN gaming system may be substantially identical to the LAN gaming system described above, although the number of gaming machines in each system may vary relative to each other.

The data network may be the Internet or an intranet. In this embodiment, the operation of gaming machine 10 can be viewed at gaming machine 10 with at least one internet browser. The operation of gaming machine 10 and accumulation of credits may be accomplished with only a connection to server 208 (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

In the exemplary embodiment, one or more of gaming machine 10 are in communication with each other and/or server 208 through gaming network 206. In this embodiment, server 208 is any suitable server or computing device that includes a processor, a memory 214 (shown in FIG. 3) for storing tax information of a plurality of tax jurisdictions, and/or a storage device (not shown). Server 208 is a progressive controller or a processor of one of gaming machines 10 in gaming system 200. In these embodiments, processor 12 is designed to transmit and receive events, messages, commands or any other suitable data or signal between gaming machine 10 and server 208. A gaming machine processor, for example, processor 12, is operable to execute such communicated events, messages or commands in conjunction with the operation of gaming machine 10. Moreover, the server processor (not shown) is designed to transmit and receive events, messages, commands or any other suitable data or signal between server 208 and each individual gaming machines 10. The server processor is operable to execute such communicated events, messages or commands in conjunction with the operation of server 208.

Processor 12 executes computer-executable instructions for implementing aspects of the disclosure. In some embodiments, the processor 12 is transformed into a special purpose microprocessor by executing computer-executable instructions or by otherwise being programmed. For example, the processor 12 is programmed with instructions such as illustrated in FIG. 4 and FIG. 5.

Figure 4:
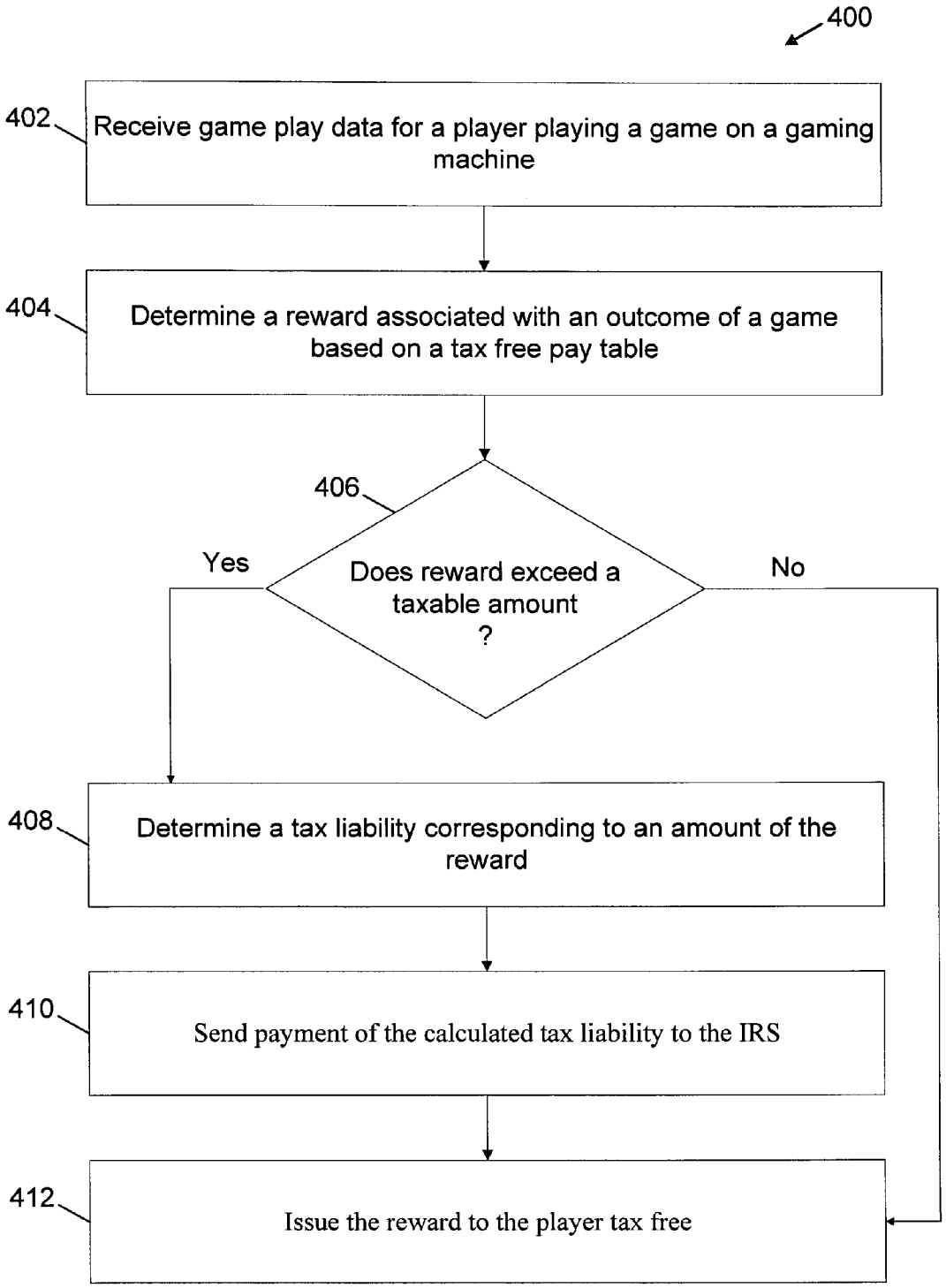
FIGS. 4 and 5 are flow diagrams of exemplary methods for issuing tax free rewards to a player.

Referring now to FIG. 4, a flow diagram of an exemplary method 400 for utilizing one or more tax jurisdictions gaming machine 10 physically resides in at a time of game play to create a tax free pay table is illustrated. Once a player funds gaming device 10 (shown in FIG. 1) to initiate game play, game play data for a player playing a game on gaming machine 10 is received at 402. The player may play the game until the player receives an indication that a reward is to be issued. At 404, a reward associated with an outcome of the game is determined based on a tax free pay table. In embodiments, the tax free pay table is created by modifying an initial pay table associated with gaming machine 10. That is, upon receiving a request for a tax free pay table, server 208 accesses an initial pay table of gaming machine 10 and modifies the initial pay table based on a tax jurisdiction gaming machine 10 physically resides in at a time of the game play. However, many locations around the world often include tax jurisdictions that overlap one another. Therefore, multiple tax requirement analysis and subsequent game/pay table modification may be required. In a further embodiment, server 208 may provide gaming machine 10 with a tax free pay table stored in memory 214. Either way, a tax free pay table includes rewards that can be issued to the player without the player paying taxes on the issued rewards regardless of an amount the reward issued to the player.

At 406, it is determined whether the reward exceeds a taxable amount, and if the reward exceeds a taxable amount a tax liability corresponding to an amount of the reward is determined at 408. At 410, payment of the calculated tax liability is sent to the IRS. Calculating tax liability may involve dynamic variables according to tax liability at a gaming establishment level, tax liability at a state level, and tax liability at an international level. Tax liability may also be fixed in some "flat rate" agreement negotiated by the gaming establishment and the IRS. Thus, in one embodiment, a gaming establishment maintains an agreed flat rate withholding of all issued rewards to compensate for an expected average over rewards that are taxable. Further, with respect to progressive pay tables, a pre-set withholding may be used. At 412, the reward is issued to the player tax free.

Figure 5:
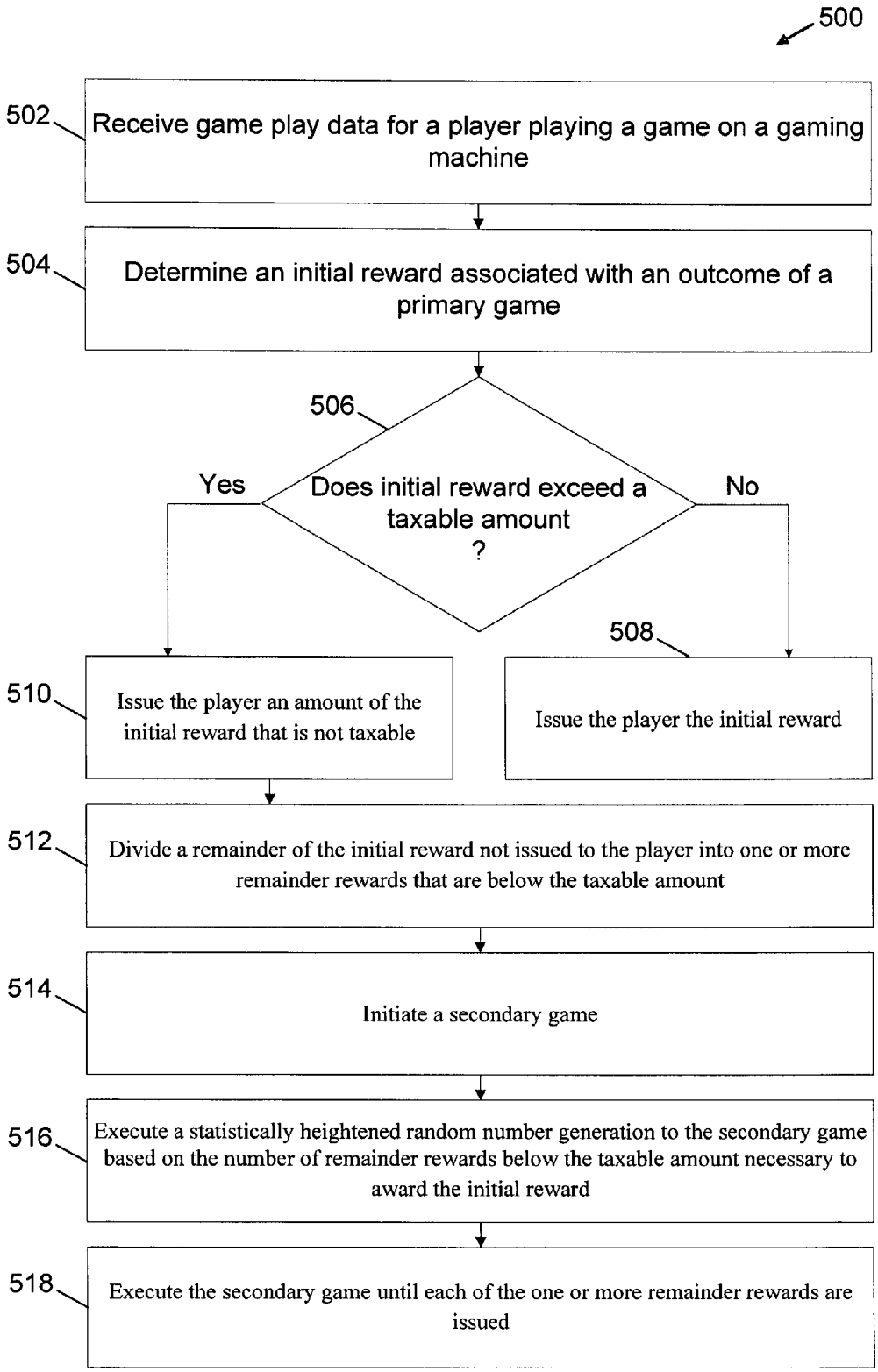

With reference now to FIG. 5, a flow diagram of an exemplary method 500 for dividing a taxable reward into one or more non-taxable rewards is illustrated. Once a player funds gaming device 10 (shown in FIG. 1) to initiate game play, game play data for a player playing a game on gaming machine 10 is received at 502. The player may play the game until the player receives an indication that a reward is to be issued. At 504, an initial reward associated with an outcome of the primary game is determined, and at 506, it is determined whether the initial reward exceeds a taxable amount based on a tax jurisdiction gaming machine 10 physically resides in at a time of the game play. If it is determined that the initial reward does not exceed a taxable amount based on the tax jurisdiction gaming machine 10 physically resides in at a time of the game play, at 508, the entire amount of the initial reward is issued to the player. However, if it is determined that the initial reward does exceed a taxable amount based on the tax jurisdiction gaming machine 10 physically resides in at a time of the game play, at 510, the player is issued an amount of the initial reward that is not taxable. For example, the player may receive an indication that an award of $10,000.00 is to be issued, going well over a $1,200.00 tax threshold. Server 208 may determine that the $10,000.00 reward is to be divided up into ten smaller rewards of $1,000.00. Thus, at the time the player receives an indication that a $10,000.00 reward is to be issued, the player automatically receives $1,000.00 of the $10,000.00 reward immediately and tax free. At 512, a remainder of the initial reward not issued to the player is divided into one or more remainder rewards that are below the taxable amount. Therefore, in the current example, the remaining $9,000.00 is divided into nine non-taxable remainder rewards of $1,000.00. However, in order for the player to receive each of the remainder rewards, a secondary game may be played. Thus, at 514, a secondary game is initiated in response to, for example, issuing the player an amount of the initial reward that is not taxable. In one embodiment, the player is able to accept or reject a secondary game. That is, the player may choose whether or not to play the secondary game at the time it is offered and therefore play the secondary game at a later time. If the player decides to play the secondary game at a later time, player tracking information (e.g., via a player card) may be used in order to indentify the player upon the player's desire to continue the secondary game. In the alternative, before or during play of the secondary game the player may refuse to play or refuse to continue to play the secondary game and immediately receive the entire initial reward (e.g., $10,000.00) less taxes, or the remainder of the entire reward less taxes.

If, however, the player decides to play the secondary game in order to receive each of the nine non-taxable remainder rewards of $1,000.00 tax free, play of the secondary games resumes. At 516, server 208 executes a statistically heightened random number generation to the secondary game based on the number of remainder rewards below the taxable amount necessary to award the initial reward. That is, server 208 determines a statistically heightened random number generation based on an amount of an award left to win, and in the current example, $9,000.00. At 518, the secondary game is executed until each of the one or more remainder rewards are issued. Thus, at the end of the secondary game, the initial reward (e.g., $10,000.00) is issued to the player tax free. The statistically heightened secondary game mode is not only controlled by a server, but exists as a persistent "state of play" that is statistically defined and modifiable until the secondary game has been completed.

In one embodiment, an advertising sponsor may agree with a gaming establishment to purchase the "tax liability" for various groups of players playing a particular game and in return be allowed to have sponsorship/advertising injected into the particular game. Thus, a player in various "sponsored" games are able to receive a much larger sum as the tax is pre-paid by the sponsor.

The present disclosure uses examples to disclose the best mode, and also to enable any person skilled in the art to practice the claimed subject matter, including making and using any devices or systems and performing any incorporated methods. The patentable scope of the present disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of operating a gaming system, the method comprising:

receiving, by an acceptor, a physical item associated with a monetary value, the physical item being one of: (1) a ticket associated with the monetary value; and (2) currency;

establishing, by at least one processor, a credit balance based at least in part on the monetary value associated with the received physical item;

randomly determining, by the at least one processor, and displaying, by at least one display device, an primary game outcome for a play of a primary game;

determining, by the at least one processor, a credit award associated with the determined primary game outcome;

determining, by the at least one processor, whether the credit award exceeds a designated amount;

responsive to determining that the credit award exceeds the designated amount, dividing, by the at least one processor, the credit award into: (1) a first amount that is less than the designated amount; and (2) a second amount;

increasing, by the at least one processor, the credit balance based on the first amount;

determining, by the at least one processor and based on the second amount, one or more remainder awards, each remainder award being less than the designated amount;

initiating, by the at least one processor, a secondary game in response to increasing the credit balance based on the first amount, wherein the one or more remainder awards are winnable via play of the secondary game;

providing, by the at least one processor, plays of the secondary game until the player wins each remainder award, the credit balance increasable by each won remainder award; and initiating, by the at least one processor, a payout associated with the credit balance responsive to an actuation of a cashout button.

2. The method of claim 1, wherein a sum of the first amount and the one or more remainder awards is equal to the credit award.

3. The method of claim 2, which includes executing, by the at least one processor, a statistically heightened random number generation for each play of the secondary game.

4. The method of claim 1, which includes enabling the player to play the secondary game at a later point in time.

5. The method of claim 1, which is at least partially provided through a data network.

6. The method of claim 5, wherein the data network is an internet.

7. A gaming machine comprising:

a housing;

at least one processor;

at least one display device supported by the housing;

at least one input device supported by the housing;

an acceptor supported by the housing and configured to receive a physical item associated with a monetary value, the physical item being one of: (1) a ticket associated with the monetary value; and (2) currency; and at least one memory device that stores a plurality of instructions which, when executed by the at least one processor, cause the at least one processor to operate with the at least one display device, the acceptor, and the at least one input device to:

(a) establish a credit balance based at least in part on the monetary value associated with the physical item responsive to receipt of the physical item by the acceptor;

(b) randomly determine a primary game outcome for a play of a primary game;

(c) determine a credit award associated with the determined primary game outcome;

(d) determine whether the credit award exceeds a designated amount;

(e) responsive to determining that the credit award exceeds the designated amount, divide the credit award into: (1) a first amount that is less than the designated amount; and (2) a second amount;

(f) increase the credit balance based on the first amount;

(g) determine, based on the second amount, one or more remainder awards, each remainder award being less than the designated amount;

(h) initiate a secondary game in response to increasing the credit balance based on the first amount, wherein the one or more remainder awards are winnable via play of the secondary game; and (i) provide plays of the secondary game until the player wins each remainder award, the credit balance increasable by each won remainder award; and (j) initiate a payout associated with the credit balance responsive to an actuation of a cashout button.

8. The gaming machine of claim 7, wherein a sum of the first amount and the one or more remainder awards is equal to the credit award.

9. The gaming machine of claim 8, wherein the plurality of instructions, when executed by the at least one processor, cause the at least one processor to execute a statistically heightened random number generation for each play of the secondary game.

10. The gaming machine of claim 7, wherein the plurality of instructions, when executed by the at least one processor, cause the at least one processor to enable the player to play the secondary game at a later point in time.

11. A gaming system comprising:

at least one server; and a gaming machine including (i) a housing;

(ii) at least one processor;

(iii) at least one display device supported by the housing;

(iv) at least one input device supported by the housing (v) an acceptor supported by the housing and configured to receive a physical item associated with a monetary value, the physical item being one of: (1) a ticket associated with the monetary value; and (2) currency; and (vi) at least one memory device that stores a plurality of instructions that, when executed by the at least one processor, cause the at least one processor to operate with the at least one display device, the acceptor, and the at least one input device, wherein the at least one server is configured to operate with the gaming machine to:

(a) establish a credit balance based at least in part on the monetary value associated with the physical item responsive to receipt of the physical item by the acceptor;

(b) randomly determine a primary game outcome for a play of a primary game;

(c) determine a credit award associated with the determined primary game outcome;

(d) determine whether the credit award exceeds a designated amount;

(e) responsive to determining that the credit award exceeds the designated amount, divide the credit award into: (1) a first amount that is less than the designated amount; and (2) a second amount;

(f) increase the credit balance based on the first amount;

(g) determine, based on the second amount, one or more remainder awards, each remainder award being less than the designated amount;

(h) initiate a secondary game in response to increasing the credit balance based on the first amount, wherein the one or more remainder awards are winnable via play of the secondary game;

(i) provide plays of the secondary game until the player wins each remainder award, the credit balance increasable by each won remainder award; and (j) initiate a payout associated with the credit balance responsive to an actuation of a cashout button.

12. The gaming system of claim 11, wherein a sum of the first amount and the one or more remainder awards is equal to the credit award.

13. The gaming system of claim 12, wherein the at least one server is configured to operate with the gaming machine to execute a statistically heightened random number generation for each play of the secondary game.

14. The gaming system of claim 11, wherein the at least one server is configured to operate with the gaming machine to enable the player to play the secondary game at a later point in time.

* * * * *